United States Patent [19]

Westergren

[11] Patent Number: 4,733,430

[45] Date of Patent: Mar. 29, 1988

[54] VACUUM CLEANER WITH OPERATING CONDITION INDICATOR SYSTEM

[75] Inventor: George A. Westergren, Linwood Township, Anoka County, Minn.

[73] Assignee: Whirlpool Corporation, Benton Harbor, Mich.

[21] Appl. No.: 939,755

[22] Filed: Dec. 9, 1986

[51] Int. Cl.[4] ..... A47L 9/19

[52] U.S. Cl. ..... 15/339; 55/274; 116/268

[58] Field of Search ..... 15/339, 319; 55/274; 116/268

[56] References Cited

U.S. PATENT DOCUMENTS

| | | | |
|---|---|---|---|
| 3,177,635 | 4/1965 | Cawl et al. | 15/339 XR |
| 4,020,525 | 5/1977 | Fromknecht et al. | 55/274 XR |
| 4,199,838 | 4/1980 | Simonsson | 15/339 |
| 4,591,369 | 5/1986 | Stewart et al. | 15/352 XR |

*Primary Examiner*—Chris K. Moore

*Attorney, Agent, or Firm*—Mason, Kolehmainen, Rathburn & Wyss

[57] ABSTRACT

A canister type vacuum cleaner includes a floor cleaning unit and a canister unit interconnected by a wand and hose assembly. The canister unit has a dust collection bag mounted in a dust collecting compartment by a pivotally movable dust bag mount that pivots to an operative position. A suction fan evacuates the air within the dust collecting compartment causing dirt laden air to flow from the floor cleaning unit through the wand and hose assembly and into the dust bag through an intake port formed in the dust bag mount. The air is exhausted from the canister unit through a discharge port. An operating condition monitoring and indicating system provides information as to the status of the dust bag and the wand and hose assembly by means of a check bag light and a check hose light. A bag mount sensor senses the differential pressure between the intake port and the dust collecting compartment; and a discharge sensor senses the differential pressure between the discharge port and the dust collecting compartment. When the dust bag becomes too clogged, the bag mount sensor and, shortly thereafter, the discharge sensor are actuated. If a restriction occurs in the wand and hose assembly, the discharge sensor, but not the bag mount sensor, is actuated.

26 Claims, 10 Drawing Figures

CHECK POWERMATE
CHECK BAG
CHECK HOSE
DISPLAY PILE HEIGHT
POWERMATE ON/OFF
DECREASE SPEED
INCREASE SPEED
POWER ON/OFF
1 2 3 4
1 2 3 4 5

20

VACUUM CLEANER WITH OPERATING CONDITION INDICATOR SYSTEM

BACKGROUND OF THE INVENTION

A. Field of the Invention

The present invention generally relates to vacuum cleaners and, more particularly, to a new and improved vacuum cleaner with an operating condition monitoring and indicating system to provide an indication of the operating conditions of a dust collecting bag and of a wand and hose assembly.

B. Description of the Prior Art

One type of vacuum cleaner is a canister type vacuum cleaner which has a wand and hose assembly extending between a canister unit and a floor cleaning unit. One end section of the wand and hose assembly is a flexible hose which is coupled to the canister unit and the other end section is a rigid, hollow tube or wand which is coupled to the floor cleaning unit. The canister has a motor operated fan for developing suction in a dust collecting compartment. A dust bag mounted in the dust collecting compartment is adapted to be connected to a suction hose connector forming one end of the flexible hose such that when the vacuum cleaner is turned on, the suction developed in the dust collecting compartment causes air to flow into the dust bag via the floor cleaning unit, the rigid wand and the flexible hose.

The air flowing into the dust bag causes a receptacle portion of the dust bag to expand. The receptacle portion of the dust bag normally is made of porous paper. Consequently, the air flowing through the porous paper exhausts through a discharge outlet in the canister unit.

In order for the vacuum cleaner to work properly and efficiently, the dust bag must not become too clogged and the air passages within the wand and hose assembly must not become restricted. Because the dust bag is typically enclosed in the dust collecting compartment, the extent to which the dust bag has become clogged cannot be readily determined by an operator of the vacuum cleaner. Moreover, visual observation of the dust bag may not indicate whether the dust bag is clogged. In certain instances, fine dust particles or powder may coat the inner walls of the dust bag and thereby restrict the pores of the dust bag even though the quantity of debris accumulated in the dust bag does not fill the dust bag.

The volume of air flowing through the wand and hose assembly also may be lessened by a debris caused restriction in the rigid wand or in the flexible hose; however, an operator of the vacuum cleaner may have to disassemble the wand and hose assembly before determining whether such a problem has developed. Consequently, it is desirable for an operator of the vacuum cleaner to be able readily to determine whether a decrease in the cleaning performance of the vacuum cleaner is due to a restriction in the wand and hose assembly or due to a clogged dust bag.

A number of different condition monitoring and indicating systems have been disclosed in the prior art. In certain prior art patents, a sensor usually in the form of a diaphragm switch is used to monitor the differential pressure between a point at or adjacent to an intake port of the vacuum cleaner and the atmosphere to provide an indication when the dust bag is too clogged for the vacuum cleaner to operate efficiently. Examples of such patents are U.S. Pat. Nos. 4,294,595 (Bowerman); 4,481,692 (Kurz); 3,172,743 (Kowalewski); 2,320,368 (Leathers) and 2,203,171 (Martinet). In other systems, the relative pressure of the suction chamber or dust collecting compartment is monitored in order to provide a warning that the dust bag has become clogged. For instance, U.S. Pat. Nos. 4,330,900 (Dorr et al); 4,199,838 (Simonsson); 4,193,292 (Simonsson); 4,124,916 (Fromknecht); and 3,381,652 (Schaefer et al) disclose such systems. Still other patents disclose systems for indicating when the dust bag has become clogged by sensing the amount of air flowing through the vacuum cleaner. These patents include U.S. Pat. Nos. 4,342,133 (Minton) and 3,452,385 (Fleck et al). In U.S. Pat. No. 4,070,170 (Leinfelt), the differential pressure between the inside of the dust bag and the bag chamber is used to determine the extent to which the dust bag has become clogged.

SUMMARY OF THE INVENTION

An object of the present invention is to provide a new and improved vacuum cleaner that has a condition monitoring and indicating system for supplying information concerning a clogged dust bag or a restriction in a wand and hose assembly of the vacuum cleaner.

Another object of the present invention is to provide a new and improved condition monitoring and indicating system for a vacuum cleaner that includes a sensor for monitoring the differential pressure between an intake port and the dust collecting compartment and another sensor to determine the differential pressure between the discharge from the vacuum cleaner and the dust collecting compartment.

Still another object of the present invention is to provide a new and improved vacuum cleaner condition monitoring and indicating system which supplies a visual signal to the operator of the vacuum cleaner when the dust bag has become clogged and another distinct signal when the wand and hose assembly has become restricted.

A still further object of the present invention is to provide a new and improved vacuum cleaner having a pivotally mounted dust bag mount through which extends an air passage so that a sensor forming a part of a condition monitoring and indicating system can monitor the relative pressure at the intake port when the vacuum cleaner is being operated.

In accordance with these and many other objects, an embodiment of the present invention includes a canister vacuum cleaner having a floor cleaning unit and a canister unit interconnected by a wand and hose assembly. The canister unit has a dust collecting compartment and a motor-suction fan unit located in a motor compartment. A dust bag mount is pivotally secured in the dust collecting compartment and pivots between non-operative and operative positions. A dust bag made of a porous material can be mounted on the dust bag mount so that when the dust bag mount is in its operative position, the dust bag is properly located in the dust collecting compartment. When the vacuum cleaner is turned on, the motor driven fan evacuates the air within the dust collecting compartment creating suction to cause dirt laden air to flow from the floor cleaning unit through the wand and hose assembly and into an intake port of the canister unit in which the wand and hose assembly is inserted. The dust laden air is drawn into the dust bag from the intake port and dirt and other debris are trapped in the dust bag. The filtered air flowing out through the porous material of the dust bag cools the fan motor and exits the canister unit through a discharge port.

The vacuum cleaner has an operating condition monitoring and indicating system to provide the operator of the vacuum cleaner with information as to the status of the dust bag and the wand and hose assembly. A check bag light and a check hose light are located on an exterior portion of the vacuum cleaner system, for example, on a display panel on a wand handle interconnecting the wand and the hose. A bag mount differential pressure sensor is mounted on a switch junction mount in the dust collecting compartment and senses the differential pressure between the intake port and the dust collecting compartment. Another pressure differential sensor located in the motor compartment senses the differential pressure between the exhaust air from the motor-suction fan unit and the dust collecting compartment. When the dust bag becomes too clogged, the bag mount sensor and, shortly thereafter, the discharge sensor are actuated. If a restriction occurs in the wand and hose assembly, the discharge sensor, but not the bag mount sensor, is actuated.

A microprocessor may be utilized to process the signals from the sensors and to activate appropriate indicator lights. The microprocessor can be used to determine if the bag mount sensor has been actuated prior to any actuation of the discharge sensor. If the bag mount sensor has been so actuated, the check bag light is energized and remains energized until the bag mount sensor is no longer actuated. In the event that the bag mount sensor is not actuated, but discharge sensor is actuated, the microprocessor, after a time delay, energizes the check hose light. The check hose light remains energized until the discharge sensor is no longer actuated. In an alternative embodiment, a hard wired control circuit is utilized to energize both the check bag light and the check hose light in response to the actuation of both the bag mount sensor and the discharge sensor (for example, when the dust bag has become clogged). On the other hand, the circuit energizes only the check hose light in response to the actuation of the discharge sensor when the bag mount sensor is not actuated.

Because the dust bag mount is pivotally mounted on the canister unit and the pressure at the intake port of the dust bag mount must be sensed by the dust bag mount sensor, the dust bag mount includes an integrally molded air passage extending from the air intake port to a outlet opening. This outlet opening is placed in communication with the inlet to the bag mount sensor whenever the dust bag mount is in its operative position so that the bag mount sensor is able to sense the pressure at the intake port.

BRIEF DESCRIPTION OF THE DRAWING

Many other objects and advantages and novel features of the present invention will become apparent from the following detailed description of a preferred embodiment of the present invention considered in conjunction with the drawing in which.

DESCRIPTION OF THE PREFERRED EMBODIMENT

Figures 1, 2, 3:
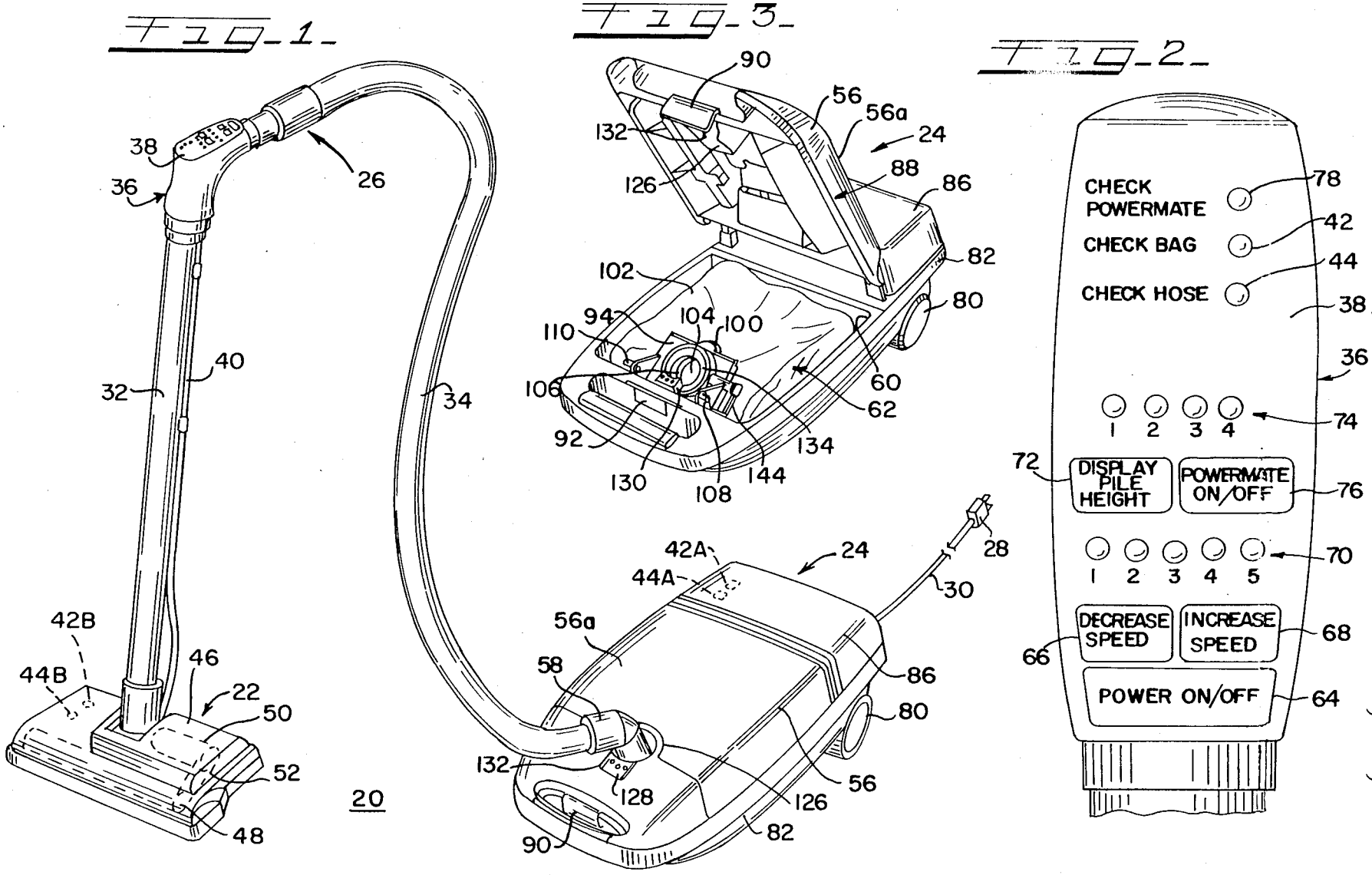
FIG. 1 is a perspective view of a vacuum cleaner constructed in accordance with the principles of the present invention.
FIG. 2 of a plan view of a wand handle control and display panel of the vacuum cleaner of FIG. 1.
FIG. 3 is a perspective view of the canister unit of the vacuum cleaner of FIG. 1 with the hood of the canister unit in its open position.

Referring more specifically to FIG. 1 of the drawing, therein is disclosed a new and improved canister vacuum cleaner 20 having a power nozzle floor cleaning unit 22 and a canister unit 24. The floor cleaning unit 22 and the canister unit 24 are mechanically, pneumatically and electrically interconnected by a wand and hose assembly 26. The vacuum cleaner 20 is powered by conventional, 110–120 volts alternating current power which is supplied to the canister unit 24 through an electrical plug 28 and a cord 30 retractably mounted to the canister unit 24.

The wand and hose assembly 26 includes a rigid wand 32 connected to a flexible hose 34 by a wand handle 36. The wand handle 36 (FIG. 2) includes a plurality of electrical controls and displays on a display panel 38. In order to supply the necessary electrical power and information to and from the wand handle 36, the flexible hose 34 has a plurality of electrical conductors (not illustrated) disposed therein and a power cord 40 is externally secured to the wand 32. In the illustrated embodiment the hose 34 includes three electrical conductors. The display panel 38 provides information to the operator of the vacuum cleaner 20 as to the operative status of various portions of the vacuum cleaner 20. This information may be provided by a plurality of sensorially perceptible, preferably visually perceptible, annunciators 42 and 44. Specifically, a check bag light 42 and a check hose light 44 are positioned on the display panel 38 of the wand handle 36. Alternatively, the lights 42 and 44 may be located on the canister unit 24 (as illustrated by a check bag light 42A and a check hose light 44A shown in dotted lines in FIG. 1) or may be located on the top of the floor cleaning unit 22 (as illustrated by a check bag light 42B and a check hose light 44B shown in dotted lines in FIG. 1). Reference herein to the check bag light 42 or the check hose light 44 should be understood to include a reference to the alternatively disposed lights 42A and 44A or to the alternatively disposed lights 42B and 44B.

Figure 4:
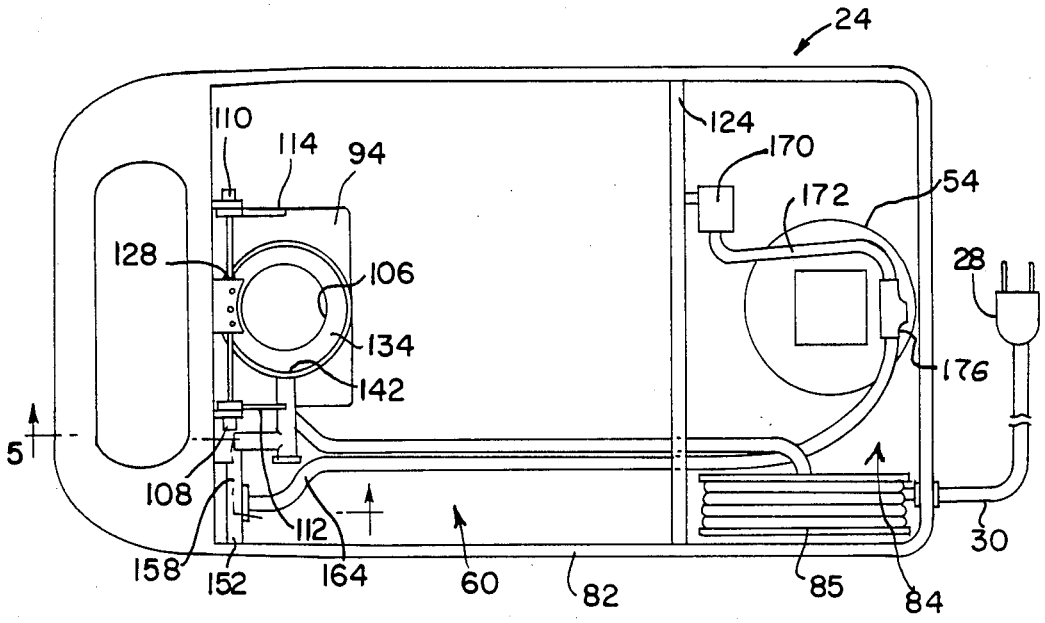
FIG. 4 is a top view of the canister unit of the vacuum cleaner of FIG. 1 with the top portion of the canister unit removed.
Figure 5:
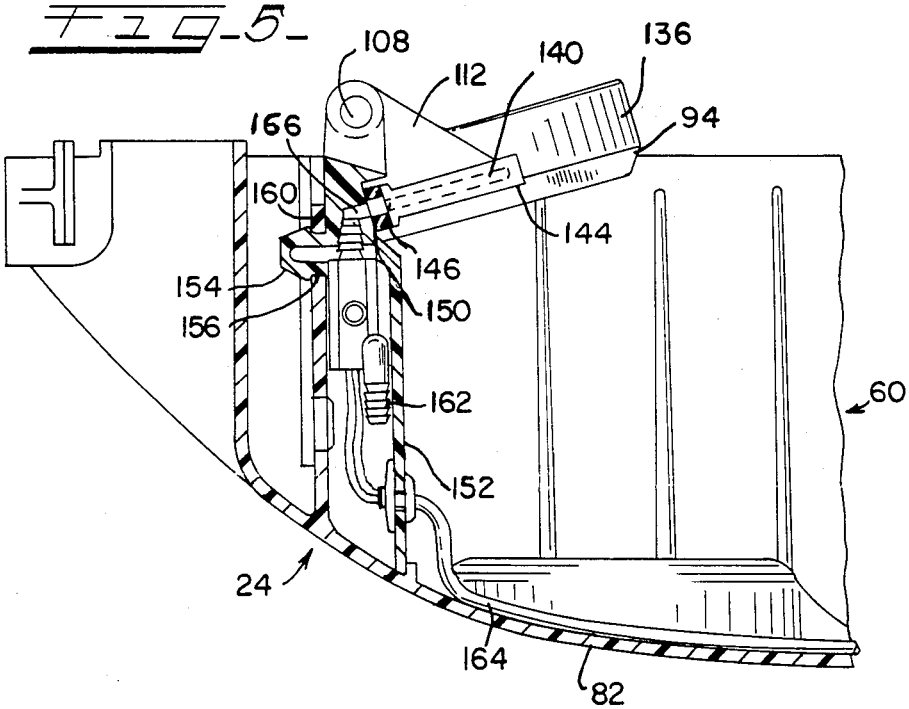
FIG. 5 is an enlarged, fragmentary, cross-sectional view of a portion of the canister unit of FIG. 4 taken along line 5—5 of FIG. 4.

The floor cleaning unit 22 (FIG. 1) includes an outer housing 46 in which is disposed a rotatable brush or agitator 48. The rotatable brush 48 is driven by an electrical, alternating current brush motor 50 through a conventional belt drive assembly 52. The alternating current power for the brush motor 50 is supplied through the cord 40. The canister unit 24 includes a motor-suction fan unit 54 (FIG. 4) having a conventional suction fan driven by an electric motor. The canister unit 24 has a hood 56 through which is inserted a suction hose connector 58 so that the hose 34 can be pneumatically connected to a dust collecting compartment 60 in the canister unit 24.

When the motor-suction fan unit 54 is energized, the suction thereby created causes a reduction in the pressure in the dust collecting compartment 60. As a result, air is drawn through the floor cleaning unit 22 and through the wand 32, the wand handle 36, the hose 34 and the connector 58 into a dust bag 62 disposed in the dust collecting compartment 60.

The operation of the unit 54 and the brush motor 50 may be controlled from the display panel 38. A switch 64 labeled "POWER ON/OFF" enables an operator to energize both the unit 54 and the brush motor 50. The electrical circuit for the vacuum cleaner may include another ON/OFF switch (not shown). A touch actuated switch 66 located adjacent the switch 64 permits the operator of the vacuum cleaner 20 to decrease the speed of the unit 54; and a touch actuated switch 68 adjacent to the switch 66 permits the operator of the vacuum cleaner 20 to increase the speed of the unit 54. By controlling the speed of the unit 54, the amount of suction can be varied. A plurality of five lights 70 visually indicate the amount of suction made available by the unit 54.

The control panel 38 also provides an operator of the vacuum cleaner 20 with the ability to control the operation of and to obtain information concerning the floor cleaning unit 22. A touch actuated switch 72 labeled "DISPLAY PILE HEIGHT" causes a sensed pile height to be displayed by a plurality of four lights 74. A touch actuated switch 76 adjacent the switch 72 and labeled "POWERMATE ON/OFF" enables an operator to selectively deenergize or energize the brush motor 50 in the floor cleaning unit 22 independently of the on/off switch 64. In addition, a "CHECK POWERMATE" light 78 is provided on the display panel 38 to indicate the operating condition of the floor cleaning unit 22. For example, the light 78 will be illuminated if the floor unit 22 has an obstruction inhibiting the rotation of the brush 48 or if the brush 48 is not being rotated due to the belt drive assembly 52 becoming inoperative. The control circuitry associated with the functions controlled by the switches 64, 66, 68, 72 and 76 and the indicating lights 70, 74 and 78 is more fully described in copending and commonly assigned U.S. patent application Ser. No. 815,384, filed on Dec. 31, 1985, now U.S. Pat. No. 4,654,924, issued Apr. 7, 1987, which application is hereby incorporated herein by reference.

In order to facilitate the movement of the canister unit 24, a plurality of wheels 80 are secured to the underside of a base 82 that houses the dust collecting compartment 60 and a motor compartment 84. The motor compartment 84 may include a cord reel 85 for storing the cord 30 in the motor compartment 84. A cover 86 encloses the motor compartment 84; and the hood 56 is pivotally mounted to the base 82 so that it can be selectively placed in a closed position (FIG. 1) or in an open position (FIG. 3).

When the hood 56 is closed, attachments stored in an attachment compartment 88 molded into the hood 56 beneath a hinged hood lid 56*a* may be obtained by opening the lid 56*a*. The hood 56 includes a latch 90 that engages a latch slot 92 at the front of the base 82 so that the hood 56 is maintained closed until the latch 90 is released by an operator of the vacuum cleaner 20. When the hood 56 is open, the dust bag 62 may be mounted on a dust bag mount 94 in the dust collecting compartment 60 (FIG. 3).

The dust bag mount 94 is made of molded plastic and includes a pair of opposed channels 96 and 98 into which a collar 100 of the dust bag 62 may be inserted. The collar 100 is preferably flat and made of a flexible, inexpensive material, such as cardboard or chipboard. The collar 100 is bonded, for example by gluing, to a receptacle portion 102 of the dust bag 62, the receptacle portion 102 typically being made of porous paper. When the collar 100 is properly positioned in the channels 96 and 98, an aperture 104 in the central portion of the collar 100 is in alignment with an aperture or intake port 106 in the central portion of the dust bag mount 94. The aperture 104 provides access to the receptacle portion 102 of the dust bag 62.

Figure 6:
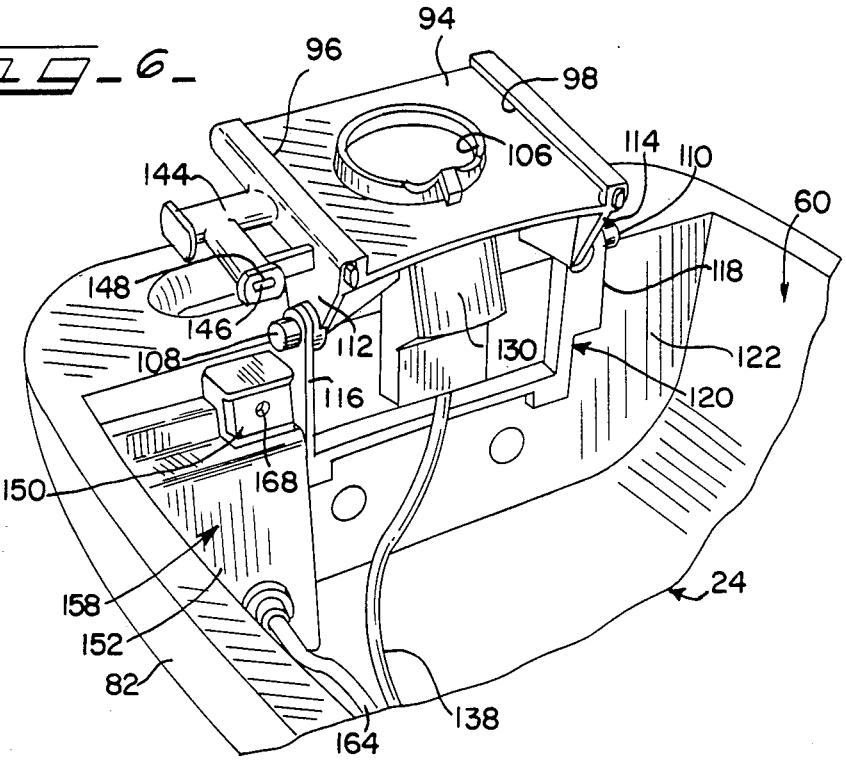
FIG. 6 is an enlarged, fragmentary, perspective view of the front portion of the canister unit of the vacuum cleaner of FIG. 1 with the dust bag mount in its non-operative position.
Figure 7:
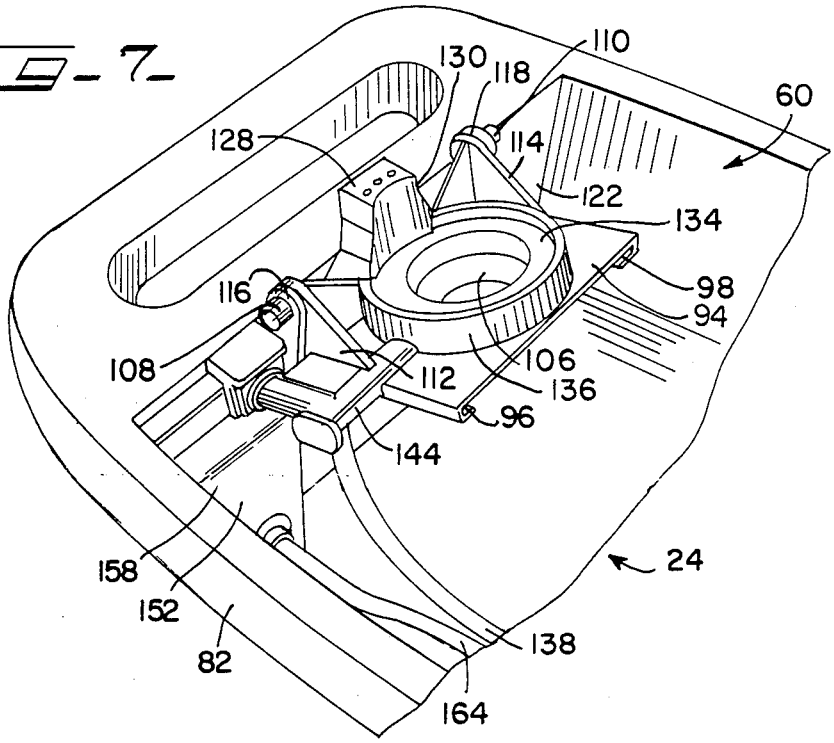
FIG. 7 is an enlarged, fragmentary, perspective view of the front portion of the canister unit of the vacuum cleaner of FIG. 1 with the dust bag mount in its operative position.

The dust bag mount 94 (FIGS. 6 and 7) is pivotally mounted to the base 82 of the canister unit 24 by a pair of pivot posts 108 and 110 extending outwardly from opposed side edges 112 and 114 of the dust bag mount 94. The pivot posts 108 and 110 project through opposed legs 116 and 118, respectively, of a dust bag mount bracket 120 which is secured to a front wall 122 of the base 82 in the inside portion of the dust collecting compartment 60. The hood 56 may be pivoted to its open disposition (FIG. 3) under the influence of a spiral spring (not shown) wound about the pivot post 110.

Advantageously, the pivoting of the dust bag mount 94 to its non-operative position (FIG. 6) enables an operator of the vacuum cleaner 20 to easily insert the collar 100 of the dust bag 62 into the channels 96 and 98 so that the dust bag 62 may be readily positioned on the dust bag mount 94. Moreover, when no dust bag 62 is positioned on the dust bag mount 94 and the hood 56 is in its open disposition, the movement of the dust bag mount 94 (FIG. 6) inhibits an operator from closing the hood 56 without first inserting a dust bag 62 onto the dust bag mount 94. As a result, there is less likelihood that an operator of the vacuum cleaner 20 will start the vacuum cleaner 20 without first inserting a dust bag 62 into the dust collecting compartment 60. If a dust bag 62 is not so inserted in a dust collecting compartment 60 and properly positioned on the dust bag mount 94, the vacuum cleaner 20 can be damaged due to the fact that dust laden air will be transmitted into the dust collecting compartment 60 and into the motor compartment 84. Such dust laden air can damage the motor-suction fan unit 54. To further prevent any dust laden air from entering into the motor compartment 84, a filter (not shown) is provided in the wall 124 that separates the dust collecting compartment 60 from the motor compartment 84 and that has access openings so that air may flow from the dust collecting compartment 60 into the motor compartment 84.

After a dust bag 62 is mounted on the dust bag mount 94, the dust bag mount 94 may be pivoted to an operative position (FIG. 7); and the hood 56 may be closed. Thereafter, the dust bag mount 94 is held in its operative position so that an access or inlet opening 126 in the hood 56 is aligned with the aperture 106 in the dust bag mount 94; and a top portion 128 of an electrical connector 130 is positioned in a slot 132 adjacent the inlet opening 126. With the hood 56 closed, the suction hose connector 58 may be inserted through the inlet opening 126 to become lodged in the aperture 106 against a sealing gasket 134 disposed in a circular flange 136 surrounding the aperture 106. The gasket 134 ensures that a proper seal is thereby obtained between the wand and hose assembly 26 and the dust bag 62. When the suction hose connector 58 is so positioned in the intake port 106, a plug (not shown) engages the connector 130 so as to electrically connect a power cord 138 in the canister 24 to the electrical conductors in the wand and hose assembly 26.

In order to sense the pressure at the intake port 106 relative to the pressure in the dust collecting compartment 60, the dust bag mount 94 is provided with an air passage 140. The air passage 140 extends from an intake port hole 142 at the aperture 106, through an air passage tube 144 formed integrally with the side edge 112 of the dust bag mount 94, and to an outlet opening 146 at an end 148 of the tube 144. When the dust bag mount 94 is in its operative position (FIGS. 3, 4, 5 and 7), the end 148 of the tube 144 engages a compliant, rubber gasket or seal 150 mounted on a switch junction mount 152. The switch junction mount 152 is held on the front interior wall 122 of the base 82 by lugs 154 extending into holes 156 in the wall 122. The switch junction mount 152 has mounted therein a bag mount sensor 158. The bag mount sensor 158 is responsive to a preselected differential pressure sensed between an inlet port 160 and an outlet port 162. The sensor 158 is a conventional differential pressure sensor available from several different pressure sensor or switch manufacturers. When the preselected differential pressure is sensed, for example, a differential pressure equivalent to approximately 30 to 35 inches of water, contacts within the sensor 158 are closed (or opened depending upon the logic desired) to provide a logic signal to conductors 164 extending out from the sensor 158 through the switch junction mount 152.

The inlet port 160 (FIG. 5) of the sensor 158 is in communication with a passage 166 formed in the switch junction mount 152. The passage 166 in turn communicates with a hole 168 in the gasket 150 such that when the dust bag mount 94 is in its operative position, the air passage 140 is in communication with the inlet port 160 via the hole 168 and the air passage 166. The outlet port 162 extends behind the switch junction mount 152 into the dust collecting compartment 60. Consequently, the sensor 158 senses the differential pressure between the intake port 106 and the dust collecting compartment 60. In the preferred embodiment of the present invention, the sensor 158 is adjusted such that when a differential pressure equivalent to approximately 30 to 35 inches of water is sensed between the inlet port 160 and the outlet port 162, the sensor 158 will be actuated and a signal will be supplied to the conductors 164. The air passage 144 in the dust bag mount 94 enables the pressure at the intake port 106 to be sensed by the sensor 158 through the pivotal dust bag mount 94.

Another pressure differential switch in the form of a discharge sensor 170 (FIG. 4) of the same general type as the sensor 158 is positioned to sense the differential pressure between the dust collecting compartment 60 and the discharge of the motor-suction fan unit 54. In the preferred embodiment, the sensor 170 is adjusted to respond to or be activated by a differential pressure between the dust collecting compartment 60 and the discharge of the unit 54 equivalent to approximately 57 inches of water, plus or minus 3 inches of water. When actuated by such a differential pressure, a logic signal is supplied to conductors 172.

Figure 8:
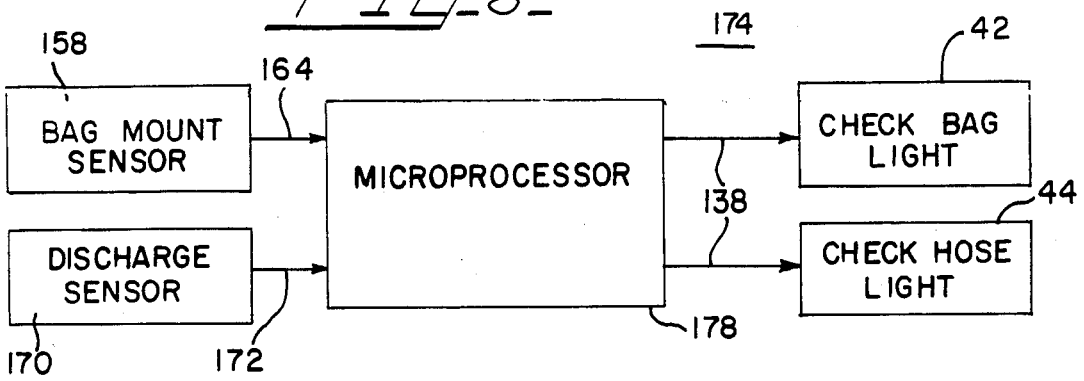
FIG. 8 is a block diagram of a circuit used as a part of an condition monitoring and indicating system to provide information as to the condition of the hose and dust bag of the vacuum cleaner of FIG. 1.

The sensors 158 and 170 form a part of a condition monitoring an indicating electronic control circuit 174 (FIG. 8) conveniently disposed, for example, in a control panel 176 in the motor compartment 84. In the circuit 174, the status of the bag mount sensor 158 and of the discharge sensor 170 is supplied via the conductors 164 and 172, respectively, to a microprocessor 178. The microprocessor 178 may be, for example, a Motorola 6809 microprocessor, although any one of a variety of commercially available microprocessors having conventional capabilities could be used.

The bag mount sensor 158 and the discharge sensor 170 generally respond both to the amount of clogging occurring in the dust bag 62 and to the restriction of the air passages in the wand and hose assembly 26. For example, if the receptacle portion 102 of the dust bag 62 becomes clogged because of the amount of debris that has accumulated therein or because the pores in the wall of the receptacle portion 102 have become sufficiently blocked due to a coating of fine dust or powder, the negative pressure in the dust bag 62 decreases and the negative pressure in the dust collecting compartment 60 increases. As a result, the pressure differential increases between the intake port 106 and the dust collecting chamber 60. The dust bag mount sensor 158 is then actuated when the dust bag 62 becomes sufficiently clogged to provide a logic input signal to the microprocessor 178.

In addition, due to the decreasing pressure, i.e., increasing negative pressure, in the dust collecting compartment 60, the pressure differential between the discharge of the unit 54 and the dust collecting compartment 60 also increases, resulting in the discharge sensor 170 being actuated to provide a second logic input signal to the microprocessor 178. Because the bag mount sensor 158 responds to an increasing pressure differential earlier in time than the discharge sensor 170, the bag mount sensor 158 is actuated before the discharge sensor 170 is actuated when the dust bag 62 becomes too clogged. The microprocessor 178 determines from the logic input signals this sequence of actuation of the sensors 158 and 170 and through an enabling output signal provides a visual indication of a clogged bag condition to the operator of the vacuum cleaner 20 by illuminating the check bag light 42.

When a restriction occurs in the wand and hose assembly 26, the pressure in the dust collecting compartment 60 again decreases (increased vacuum). The discharge sensor 170 is actuated when the pressure differential between the dust collecting compartment 60 and the discharge of the unit 54 exceeds the equivalent of the vacuum pressure of a vertical column of water approximately 57 inches in height. Because the pressure differential between the intake port 106 and the dust collecting compartment 60 is relatively low, the bag mount sensor 158 is not actuated. The microprocessor 178 detects from the logic input signals that the discharge sensor 170 is actuated and the bag mount sensor 158 is not actuated. In response thereto, the check hose light 44 is illuminated to indicate to an operator that a restriction is present in the wand 32 or in the hose 34.

Figure 9:
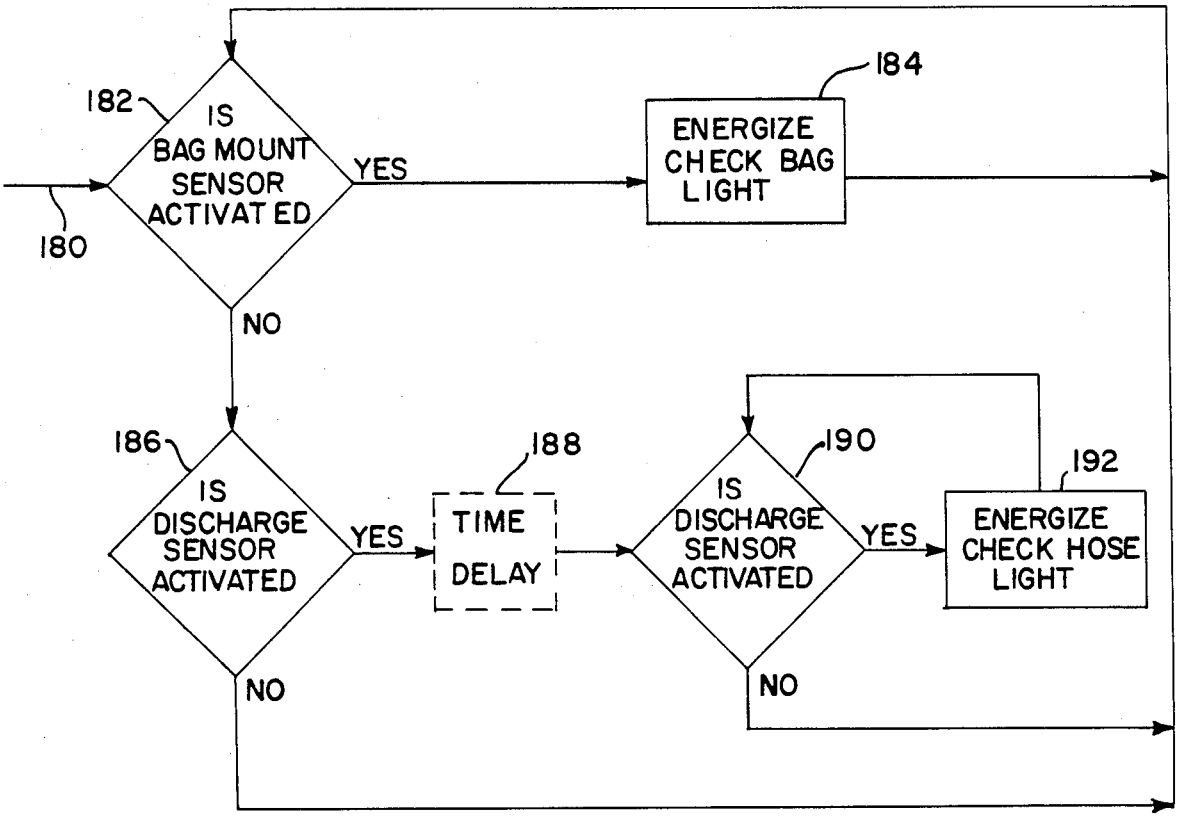
FIG. 9 is a logic flow chart depicting the logic operation of the microprocessor depicted in the circuit of FIG. 8.

One general logic flow chart for programming the microprocessor 178 is set forth in FIG. 9. When the vacuum cleaner 20 is turned on (line 180), the status of the bag mount sensor 158 is evaluated (decision block 182). If the bag mount sensor 158 has been actuated, the check bag light 42 is energized (function block 184). The check bag light 42 remains energized as long as the bag mount sensor 158 is actuated; and, during this time, the status of the bag mount sensor 158 is continuously evaluated.

If the bag mount sensor 158 is not actuated, the status of the discharge sensor 170 is evaluated (decision block 186). If the discharge sensor 170 is not actuated, the status of the bag mount sensor 158 is again evaluated. If the discharge sensor 170 is actuated, then after an optional, predetermined time delay (variably preselected from a range of from zero to thirty seconds), the status of the discharge sensor 170 is again evaluated (decision block 190). This second check of the status of the discharge sensor 190 may be eliminated if the time delay 188 is not utilized. If the discharge sensor 170 is no longer actuated, the status of the bag mount sensor 158 is again evaluated. If the discharge sensor 170 is still actuated, the check hose light 44 is energized (function block 192). Once the check hose light 44 is energized, the status of the discharge sensor 170 may be continuously evaluated.

Because the microprocessor 178 evaluates the status of the bag mount sensor 158 prior to evaluating the status of the discharge sensor 170, the actuation of the bag mount sensor 158 results in the illumination of the check bag light 42 whether or not the discharge sensor 170 is actuated. If the wand and hose assembly 26 becomes too restricted, the discharge sensor 170 is actuated, but the bag mount 158 is not actuated. By evaluating the status of the discharge sensor 170 subsequent to the evaluation of the status of the bag mount sensor 158, the microprocessor 178 can determine whether the operation of the vacuum cleaner 20 has been adversely affected by a clogged bag condition or by a restricted wand or hose condition.

Figure 10:
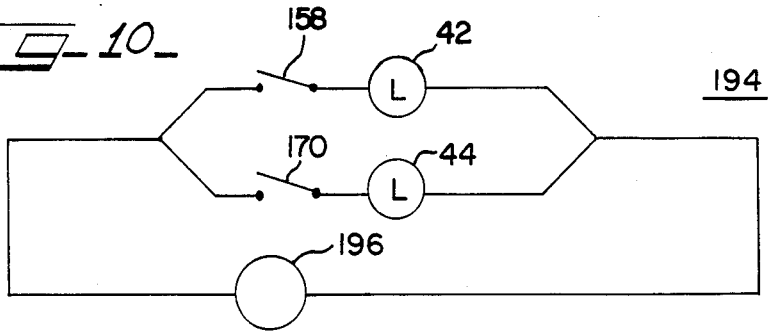
FIG. 10 is an alternative electrical schematic circuit for use as a part of a condition monitoring and indicating system to provide information as to the condition of the hose and dust bag of the vacuum cleaner of FIG. 1.

Alternatively, a hard wired electrical control circuit 194 (FIG. 10) may be used to monitor the sensors 158 and 170 and to control the illumination of the lights 42 and 44. When the dust bag 62 becomes sufficiently clogged, the bag mount sensor 158 is actuated (closed) and, shortly thereafter, the discharge sensor 170 also is actuated (closed). In such a case, both the check bag light 42 and the check hose light 44 are illuminated by a suitable power source 196. When the wand and hose assembly 26 becomes restricted, only the discharge sensor 170 is actuated (closed) to illuminate the check hose light 44.

Obviously, many modifications and variations of the present invention will become apparent from the above teachings. Thus, it is to be understood that, within the scope of the appended claims, the invention may be practiced otherwise than as specifically described hereinabove.

What is claimed and desired to be secured by Letters Patent is:

1. A vacuum cleaner system condition indicator for use with a vacuum cleaner having an intake port, a dust collecting compartment, a dust bag in said compartment and a discharge port, comprising first sensing means for sensing a first pressure differential between said intake port and said dust collecting compartment, said first sensing means providing a first sensing signal when said sensed first pressure differential is of at least a first magnitude, second sensing means for sensing a second pressure differential between said discharge port and said dust collecting compartment, said second sensing means providing a second sensing signal when said sensed second pressure differential is of a least a second magnitude, and indicator means associated with said first and second sensing means for providing sensorially perceptible indicating signals in response to said first and second sensing signals.

2. A condition indicator as recited in claim 1 wherein said first sensing means includes first switch means actuated in response to the existence of a pressure differential of at least a first magnitude between said intake port and said dust collecting compartment.

3. A condition indicator as recited in claim 2 wherein said first magnitude is a pressure differential equivalent to approximately 30 to 35 inches of water.

4. A condition indicator as recited in claim 2 wherein said second sensing means includes second switch means actuated in response to the existence of a pressure differential of at least a second magnitude between said discharge port and said dust collecting compartment.

5. A condition indicator as recited in claim 4 wherein said second magnitude is a pressure differential equivalent to approximately 57 inches of water.

6. A condition indicator as recited in claim 4 wherein said indicator means includes a first indicating light illuminated in response to the actuation of said first switch means.

7. A condition indicator as recited in claim 6 wherein said indicator means includes a second indicating light illuminated in response to the actuation of said second switch means.

8. A condition indicator as set forth in claim 6 wherein said indicator means includes a second indicating light illuminated in response to the actuation of said second switch means and the non-actuation of said first switch means.

9. A condition indicator as recited in claim 1 wherein said indicator means includes a microprocessor.

10. A vacuum cleaner dust bag mount for mounting a dust bag in a vacuum cleaner, said dust bag having a dust bag collar aperture through said collar to provide an air passage to said dust bag for the collection of debris in said dust bag, said bag mount comprising a first passageway extending through said dust bag mount, said first passageway being adapted to be aligned with said collar aperture thereby to permit the passage of debris through said dust bag mount, pressure sensing means having an air passage extending through an elongated portion of said dust bag mount for sensing the pressure at said first passageway, and pivotal mean for pivotally mounting said bag mount on said vacuum cleaner such that said bag mount is pivotable between first and second positions.

11. A vacuum cleaner dust bag mount as recited in claim 10 wherein said air passage has an inlet disposed at said first passageway and an outlet in communication with said pressure sensing means when said bag mount is pivoted to said first position.

12. A pressure responsive monitoring system for a vacuum cleaner comprising first mounting means for mounting a dust collection bag in said vacuum cleaner, said first mounting means being pivotally mounted to said vacuum cleaner and adapted to be selectively placed in an operative position, passageway means extending through said bag mount means for enabling debris to pass through said bag mount means and into said dust collection bag, air passage means having an inlet at said passageway means and an outlet, pressure responsive means for monitoring the pressure at said passageway means and second mounting means for mounting said pressure responsive means in said vacuum cleaner, said second mounting means including a second air passage in communication with said outlet when said first mounting means is in said operative position.

13. A pressure responsive monitoring system as recited in claim 12 wherein said second mounting means has seal means providing a seal between said first and second air passages when said first mounting means is in said operative position.

14. A pressure responsive monitoring system as recited in claim 13 wherein said first air passage extends through a tubular portion of said first mounting means, said outlet being at an end of said tubular portion and wherein said end engages said seal means when said first mounting means is in said operative position.

15. A pressure responsive monitoring system as recited in claim 12 wherein said dust collection bag is disposed in a dust collecting compartment of said vacuum cleaner and wherein said second mounting means mounts said pressure responsive means in said dust collecting compartment.

16. A vacuum cleaner comprising a canister unit having an air intake, a wand and hose assembly having a first end and a second end, said first end adapted to be received in said air intake, a floor cleaning unit adapted to receive said second end, a dust collecting compartment in said canister unit, a dust bag in said dust collecting compartment in pneumatic communication with said air intake, said canister unit including an air discharge and suction means, said suction means adapted to cause air to flow from said wand and hose assembly into said canister unit through said air intake, through said dust bag and out of said canister unit through said air discharge, and an operating condition indicating system including a first pressure actuated switch means responsive to the existence of a first pressure differential between said air intake and said dust collecting compartment of at least a first magnitude for providing a first sensing signal, a second pressure actuated switch means responsive to the existence of a second pressure differential between said air discharge and said dust collecting compartment of at least a second magnitude for providing a second sensing signal and signal response means for responding to said first and second sensing signals and for providing sensorially perceptible indicating signals to an operator of said vacuum cleaner.

17. A vacuum cleaner as recited in claim 16 wherein said signal response means provides a first visually perceptible signal in response to the receipt of said first sensing signal and provides a second visually perceptible signal in response to the receipt of said second sensing signal alone.

18. A vacuum cleaner as recited in claim 17 wherein said first visually perceptible signal is a check bag light and said second visually perceptible signal is a check hose light.

19. A vacuum cleaner as recited in claim 17 wherein said first and second visually perceptible signals are lights mounted on said wand and hose assembly.

20. A vacuum cleaner as recited in claim 7 wherein said first and second visually perceptible signals are lights mounted on said canister unit.

21. A vacuum cleaner as recited in claim 17 wherein said first and second visually perceptible signals are lights mounted on said floor cleaning unit.

22. A vacuum cleaner as recited in claim 17 wherein said first visually perceptible signal is an indication of a clogged condition of said dust bag and said second visually perceptible signal is an indication of a restricted condition of said wand and hose assembly.

23. A vacuum cleaner as recited in claim 17 wherein said signal response means determines the order in which said first and second sensing signals are received.

24. A vacuum cleaner as recited in claim 16 wherein said first magnitude is a pressure differential less than the pressure differential of said second magnitude.

25. A vacuum cleaner as recited in claim 16 wherein said first magnitude is a pressure differential equivalent to approximately 30 to 35 inches of water.

26. A vacuum cleaner as recited in claim 25 wherein said second magnitude is a pressure differential equivalent to appproximately 54 to 60 inches of water.

* * * * *

UNITED STATES PATENT AND TRADEMARK OFFICE

CERTIFICATE OF CORRECTION

PATENT NO. : 4,733,430

DATED : March 29, 1988

INVENTOR(S) : George A. Westergren

It is certified that error appears in the above-identified patent and that said Letters Patent is hereby corrected as shown below:

Column 10, line 46, after "collar" insert --and a collar--

Column 10, line 59, change "pivotable" to --pivotal--

Column 12, line 28, change "7" to --17--

Signed and Sealed this

Twenty-third Day of August, 1988

*Attest:*

DONALD J. QUIGG

*Attesting Officer*

*Commissioner of Patents and Trademarks*